US010086254B2

(12) United States Patent
Watterson

(10) Patent No.: US 10,086,254 B2
(45) Date of Patent: Oct. 2, 2018

(54) ENERGY EFFICIENCY INDICATOR IN A TREADMILL

(71) Applicant: ICON Health & Fitness, Inc., Logan, UT (US)

(72) Inventor: Scott R. Watterson, Providence, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 69 days.

(21) Appl. No.: 15/460,919

(22) Filed: Mar. 16, 2017

(65) Prior Publication Data

US 2017/0266535 A1 Sep. 21, 2017

Related U.S. Application Data

(60) Provisional application No. 62/310,532, filed on Mar. 18, 2016.

(51) Int. Cl.
*A63B 24/00* (2006.01)
*A63B 71/06* (2006.01)
(Continued)

(52) U.S. Cl.
CPC ..... *A63B 71/0686* (2013.01); *A63B 21/0054* (2015.10); *A63B 22/0023* (2013.01); *A63B 22/0242* (2013.01); *A63B 24/0087* (2013.01); *A63B 71/0622* (2013.01); *A63B 2024/009* (2013.01); *A63B 2024/0068* (2013.01); *A63B 2024/0096* (2013.01); *A63B 2071/0081* (2013.01); *A63B 2071/065* (2013.01); *A63B 2071/0638* (2013.01); *A63B 2071/0694* (2013.01); *A63B 2207/02* (2013.01);
(Continued)

(58) Field of Classification Search
CPC ..... A63B 71/0686; A63B 71/0622; A63B 22/0023; A63B 22/0242; A63B 24/0087; A63B 21/0054; A63B 2230/75; A63B 2230/06; A63B 2024/009; A63B 2024/0096; A63B 2071/0081; A63B 2071/0638; A63B 2071/065; A63B 2071/0694; A63B 2207/02; A63B 2220/20; A63B 2220/24; A63B 2220/51; A63B 2225/20; A63B 2225/50
See application file for complete search history.

(56) References Cited

U.S. PATENT DOCUMENTS

2002/0045517 A1* 4/2002 Oglesby ..... A63B 22/0023 482/51
2007/0161466 A1* 7/2007 Oglesby ..... A63B 22/0023 482/54
(Continued)

*Primary Examiner* — Glenn Richman
(74) *Attorney, Agent, or Firm* — Holland & Hart LLP

(57) ABSTRACT

An exercise device includes a frame and an exercise deck. The exercise deck includes a platform, a first pulley connected to a front portion of the platform, a second pulley connected to a rear portion of the platform, and a tread belt surrounding the first pulley and the second pulley. The exercise device also includes a motor in mechanical communication with at least one of the first pulley and the second pulley to drive the tread belt and an energy efficiency indicator that actives in response to determining that a power load needed to operate the exercise device is below a predetermined energy efficient threshold during a performance of an exercise.

20 Claims, 6 Drawing Sheets

(51) Int. Cl.

| | |
|---|---|
| ***A63B 22/00*** | (2006.01) |
| ***A63B 22/02*** | (2006.01) |
| ***A63B 21/005*** | (2006.01) |
| *A63B 71/00* | (2006.01) |

(52) U.S. Cl.
CPC ..... *A63B 2220/20* (2013.01); *A63B 2220/24* (2013.01); *A63B 2220/51* (2013.01); *A63B 2225/20* (2013.01); *A63B 2225/50* (2013.01); *A63B 2230/06* (2013.01); *A63B 2230/75* (2013.01)

(56) References Cited

U.S. PATENT DOCUMENTS

| | | | | |
|---|---|---|---|---|
| 2013/0274066 | A1* | 10/2013 | Ashby ..... | A63B 24/0087 482/4 |
| 2016/0346618 | A1* | 12/2016 | Ashby ..... | A63B 24/0087 |

* cited by examiner

ENERGY EFFICIENCY INDICATOR IN A TREADMILL

RELATED APPLICATIONS

This application claims priority to U.S. patent application Ser. No. 62/310,532 titled "Energy Efficiency Indicator in a Treadmill" and filed on Mar. 18, 2016, which application is herein incorporated by reference for all that it discloses.

BACKGROUND

Aerobic exercise is a popular form of exercise that improves one's cardiovascular health by reducing blood pressure and providing other benefits to the human body. Aerobic exercise generally involves low intensity physical exertion over a long duration of time. Typically, the human body can adequately supply enough oxygen to meet the body's demands at the intensity levels involved with aerobic exercise. Popular forms of aerobic exercise include running, jogging, swimming, and cycling among others activities. In contrast, anaerobic exercise typically involves high intensity exercises over a short duration of time. Popular forms of anaerobic exercise include strength training and short distance running.

Many choose to perform aerobic exercises indoors, such as in a gym or their home. Often, a user will use an aerobic exercise machine to have an aerobic workout indoors. One type of aerobic exercise machine is a treadmill, which is a machine that has a running deck attached to a support frame. The running deck can support the weight of a person using the machine. The running deck incorporates a conveyor belt that is driven by a motor. A user can run or walk in place on the conveyor belt by running or walking at the conveyor belt's speed. The speed and other operations of the treadmill are generally controlled through a control module that is also attached to the support frame and within a convenient reach of the user. The control module can include a display, buttons for increasing or decreasing a speed of the conveyor belt, controls for adjusting a tilt angle of the running deck, or other controls. Other popular exercise machines that allow a user to perform aerobic exercises indoors include elliptical trainers, rowing machines, stepper machines, and stationary bikes to name a few.

One type of treadmill is disclosed in U.S. Pat. No. 9,216,316 issued to Douglas G. Bayerlein. In this reference, the invention relates to a manually operated treadmill adapted to generate electrical power comprising a treadmill frame, a running belt supported upon the treadmill frame and adapted for manual rotation, and an electrical power generator mechanically interconnected to the running belt and adapted to convert the manual rotational motion of the running belt into electrical power. One benefit of the manual treadmill according to the innovations described herein is positive environmental impact. A manual treadmill such as that disclosed herein does not utilize electrical power to operate the treadmill or generate the rotational force on the running belt. Therefore, such a treadmill can be utilized in areas distant from an electrical power source, conserve electrical power for other uses or applications, or otherwise reduce the "carbon footprint" associated with the operation of the treadmill.

SUMMARY

In one embodiment, an exercise device includes a frame and an exercise deck. The exercise deck includes a platform, a first pulley connected to a front portion of the platform, a second pulley connected to a rear portion of the platform, and a tread belt surrounding the first pulley and the second pulley. The exercise device also includes a motor in mechanical communication with at least one of the first pulley and the second pulley to drive the tread belt and an energy efficiency indicator that actives in response to determining that a power load needed to operate the exercise device is below a predetermined energy efficient threshold during a performance of an exercise.

The power load that activates the energy efficiency indicator may have the characteristic of being achieved by moving the exercise deck into an inclined orientation.

The power load that activates the energy efficiency indicator may have the characteristic of being achieved by driving the tread belt within an energy efficient speed.

The power load that activates the energy efficiency indicator may have the characteristic of being achieved by performing maintenance on the treadmill.

The energy efficiency indicator may include a light that illuminates in response to measuring below the predetermined energy efficient load.

The energy efficiency indicator may have the characteristic of displaying a green color in response to measuring below the predetermined energy efficient load.

The exercise device may include an upright structure and a console attached to the upright structure. The energy efficiency indicator may be incorporated into the console.

The energy efficiency indicator may be incorporated into the platform.

The energy efficiency indicator may indicate an amount of energy saved.

The exercise device may include an exercise deck incline mechanism and the energy efficiency indicator may be in communication with the exercise deck incline mechanism. The energy efficiency indicator may receive a command in response to activation of the exercise deck incline mechanism.

The command may include instructions to measure the power load.

The exercise device may include a processor and memory. The memory may include programmed instructions that, when executed, cause the processor to send a recommendation to the user to lower the energy used by the motor during the performance of the exercise.

The recommendation may include a message to incline the exercise deck.

In one embodiment, an exercise device includes a frame and an exercise deck. The exercise deck includes a platform, a first pulley connected to a front portion of the platform, a second pulley connected to a rear portion of the platform, and a tread belt surrounding the first pulley and the second pulley. The exercise machine also includes a motor in mechanical communication with at least one of the first pulley and the second pulley to drive the tread belt and an energy efficiency indicator that actives in response to determining that a power load needed to operate the exercise device is below a predetermined energy efficient threshold during a performance of an exercise. The energy efficiency indicator includes a light that illuminates in response to measuring below the predetermined energy efficient load. Also, the energy efficiency indicator has the characteristic of displaying a green color in response to measuring below the predetermined energy efficient load.

The exercise device may include an upright structure and a console attached to the upright structure. The energy efficiency indicator may be incorporated into the console.

The energy efficiency indicator may indicate an amount of energy saved.

The exercise device may include an exercise deck incline mechanism and the energy efficiency indicator may be in communication with the exercise deck incline mechanism. The energy efficiency indicator may receive a command to measure a power load in response to activation of the exercise deck incline mechanism.

The exercise device may include a processor and memory. The memory may include programmed instructions that, when executed, cause the processor to send a recommendation to the user to lower the energy used by the motor during the performance of the exercise.

The recommendation may include a message to incline the exercise deck.

In one embodiment, an exercise device includes a frame and an exercise deck. The exercise deck includes a platform, a first pulley connected to a front portion of the platform, a second pulley connected to a rear portion of the platform, and a tread belt surrounding the first pulley and the second pulley. The exercise machine also includes a motor in mechanical communication with at least one of the first pulley and the second pulley to drive the tread belt, an upright structure, a console attached to the upright structure, and an energy efficiency indicator incorporated into the console that actives in response to measuring a power load below a predetermined energy efficient threshold during a performance of an exercise. The energy efficiency indicator includes a light that illuminates in response to measuring below the predetermined energy efficient load. The energy efficiency indicator has the characteristic of displaying a green color in response to measuring below the predetermined energy efficient load. The exercise machine also include an exercise deck incline mechanism. The energy efficiency indicator is in communication with the exercise deck incline mechanism. The energy efficiency indicator receives a command to measure a power load in response to activation of the exercise deck incline mechanism.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other. Also, for the purposes of this disclosure, the term "power load" refers to the overall load required to move the tread belt. In some cases, the power load may be equivalent to a load on the motor that drives the tread belt, but in those circumstances where an additional power sources is used to supplement the work done by the motor, then the power load is equal to the motor load plus the additional source of power.

Figure 1:
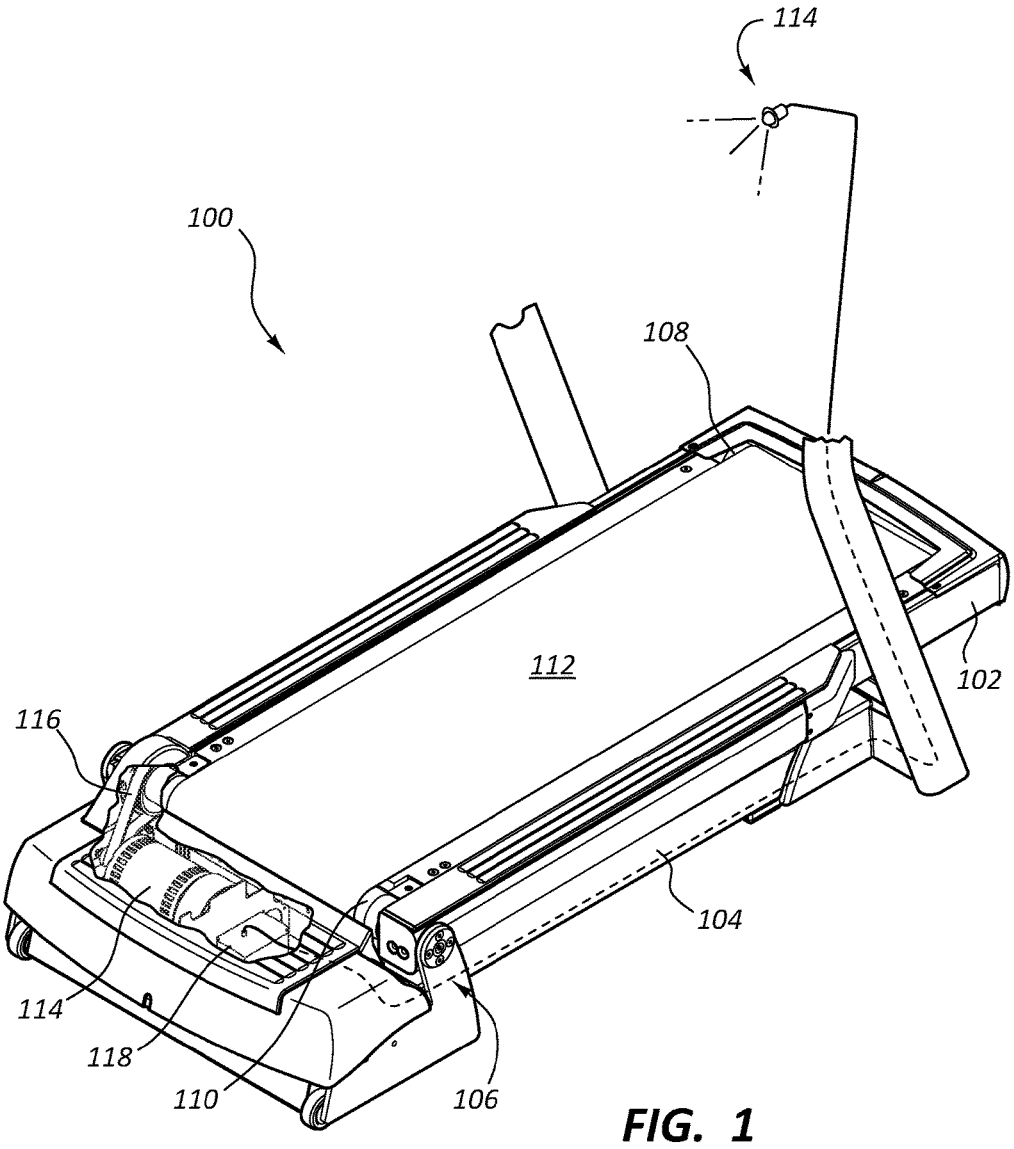
FIG. 1 illustrates a perspective view of an example of a treadmill in accordance with the present disclosure.

FIG. 1 depicts an example of a treadmill 100 having a deck 102 and a base 104. The deck 102 and the base 104 are connected at a rear pivot connection 106. The deck 102 includes a first pulley 108 disposed in a front portion of the deck 102 and a second pulley 110 incorporated into a rear portion of the deck 102. A tread belt 112 surrounds the first pulley 108 and the second pulley 110.

A motor 114 is disposed within the base 104 and is in mechanical communication with the second pulley 110 through a transmission belt 116. A power load sensor 118 is in communication with the motor 114, and an energy efficiency indicator 120 is in communication with the power load sensor 118.

Figure 2:
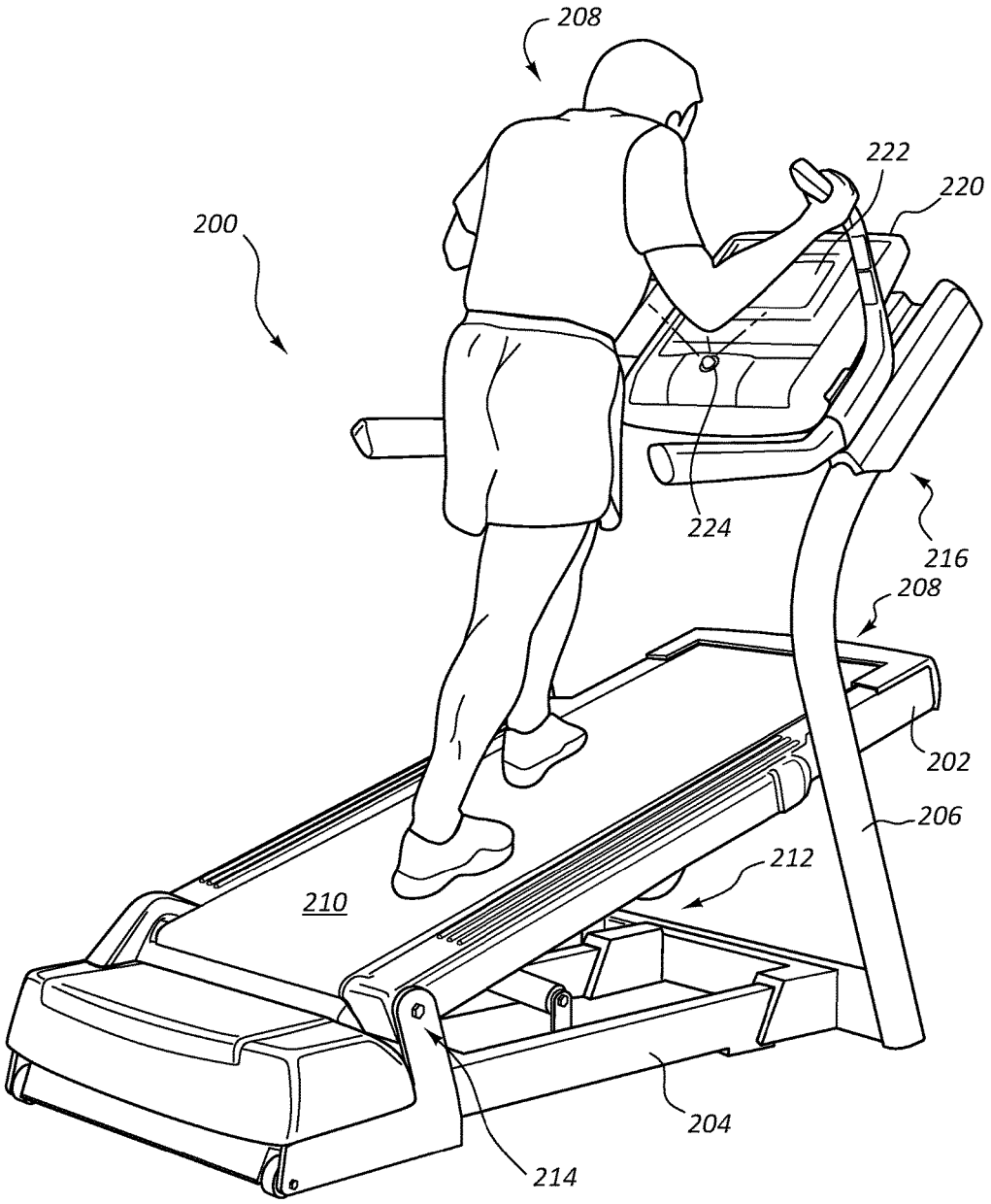
FIG. 2 illustrates a perspective view of an example of a treadmill in accordance with the present disclosure.

FIG. 2 depicts an example of a treadmill 200 that includes a deck 202, a base 204, and an upright structure 206. The deck 202 includes a platform 208 with a front pulley connected to a front portion of the platform 208, and a rear pulley connected to a rear portion of the platform 208. A tread belt 210 surrounds a portion of the platform, the front pulley, and the second pulley. A motor (not shown) can drive either the front pulley or the rear pulley and cause the tread belt 210 to move along a surface of the platform 208.

An incline mechanism 212 is integrated into the base 204 and controls an elevation of the front portion of the deck 202. The rear portion of the deck is connected to the base 204 at a pivot connection 214. As the incline mechanism raises the front portion of the deck, the rear portion of the deck 202 remains connected to the base 204, thus, the front portion of the deck 202 inclines with respect to the base 204.

An upright structure 206 is connected to the base 204. In this example, the upright structure 206 includes a first post 216 and a second post (obscured from view by the user 208). The first post 216 and the second post support a console 220. The console 220 includes a display 222 and an energy efficiency indicator 224. The energy efficiency indicator 224 may indicate when the motor load used to drive the tread belt 210 is being used efficiently. In this example, the energy efficiency indicator 224 is a light that illuminates when the power load reaches a predetermined efficiency threshold. In some examples, the light has a green color. In other examples, the energy efficiency indicator 224 may be incorporated into the display. For example, when the power load reaches the predetermined energy efficiency threshold, an icon representing the energy efficiency may appear. In other examples, the energy efficiency indicator 224 may cause a message to appear in the display 222.

Figure 3:
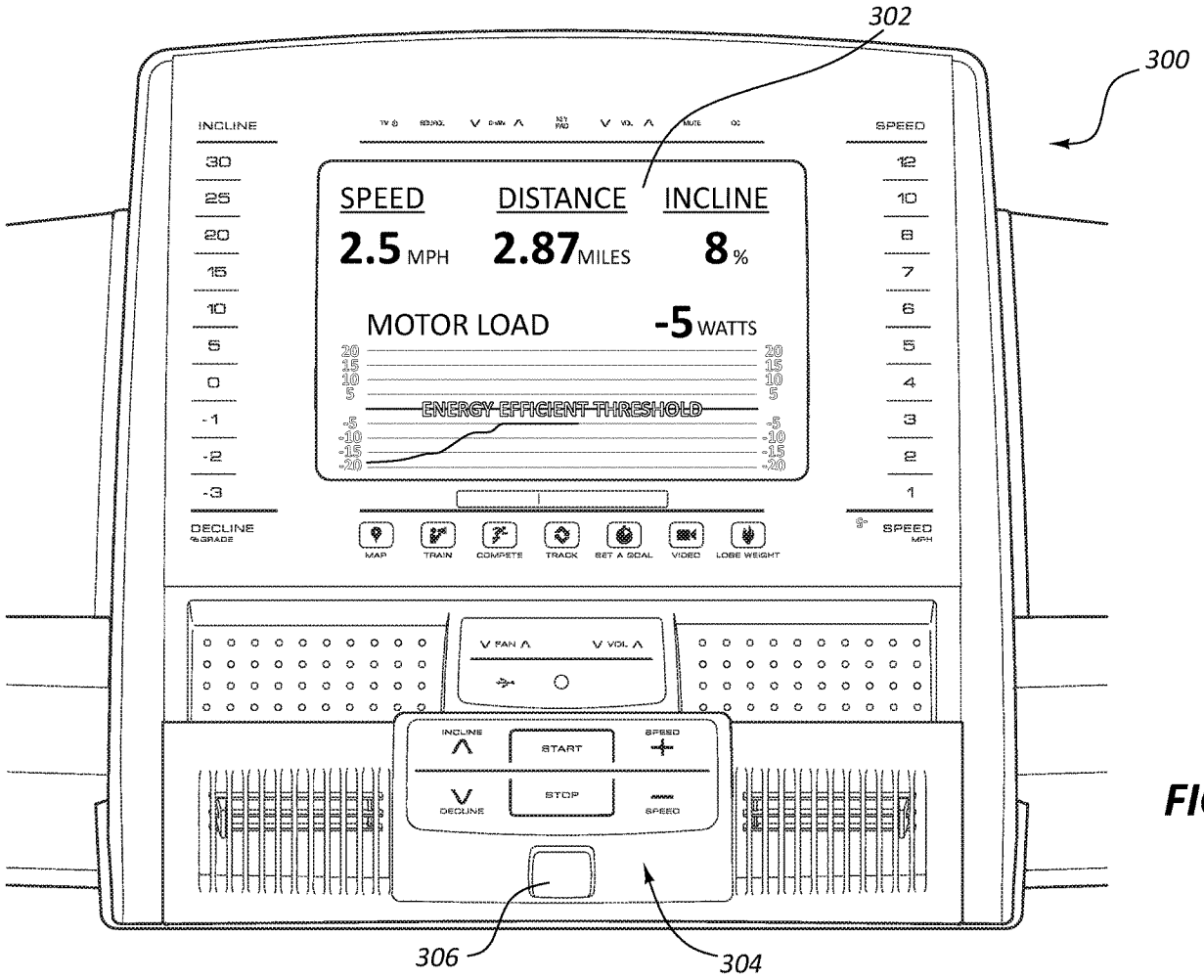
FIG. 3 illustrates a top view of an example of a console in accordance with the present disclosure.

FIG. 3 depicts an example of a console 300. In this example, the console 300 includes a display 302, treadmill controls 304, and an energy efficiency light 306. The display 302 indicates the current operating parameters of the treadmill, such as the speed that the tread belt is traveling, the distance that the tread belt has moved, and the incline of the deck. Further, the display 302 includes a chart that schematically represents the power load where the predetermined energy efficiency threshold is identified. Thus, the display may present to the user how efficiently the user is operating the treadmill during the performance of an exercise. In this example, when the treadmill is being operated in an energy efficient manner, the energy efficiency light 306 may illuminate.

Figure 4:
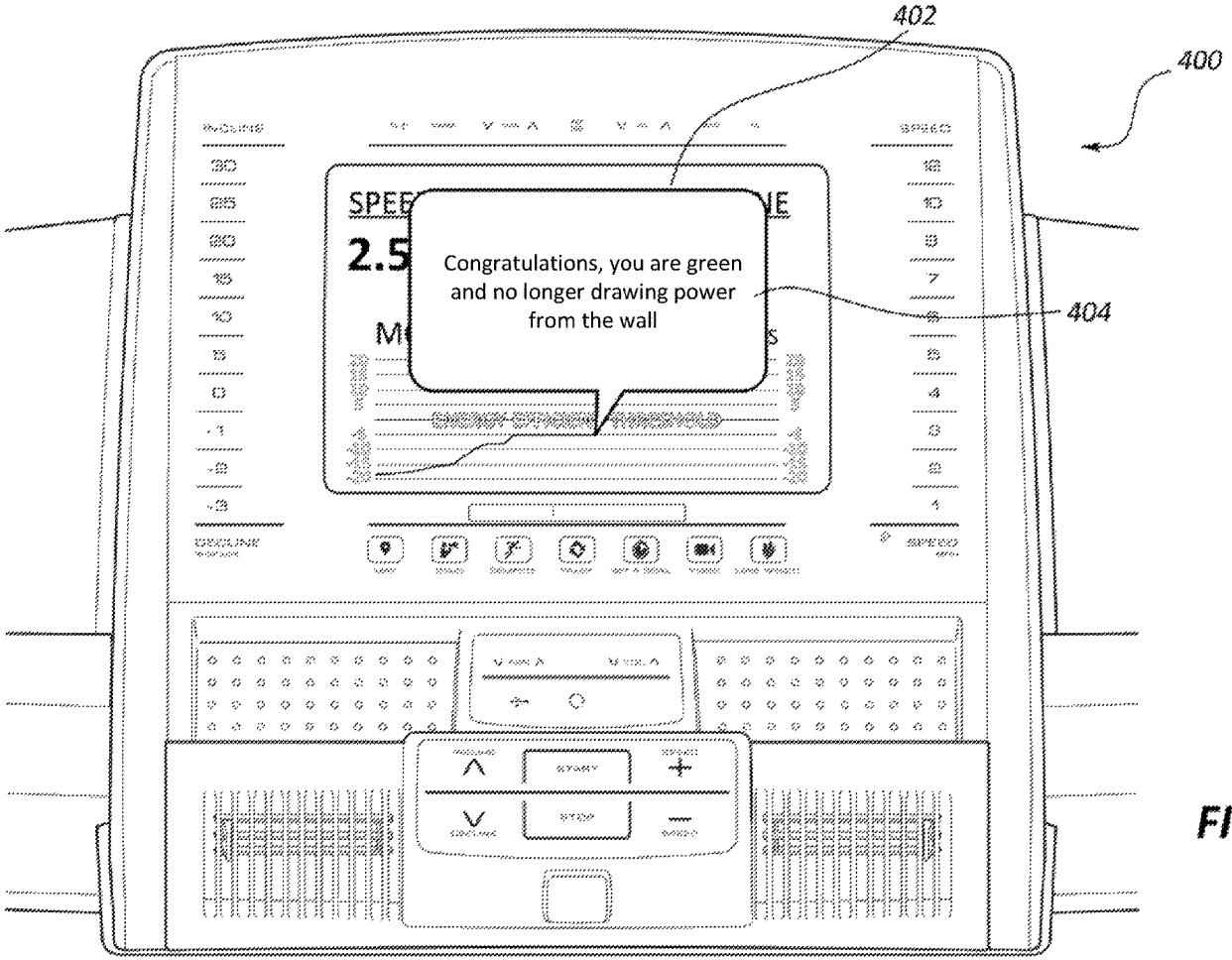
FIG. 4 illustrates a top view of an example of a console in accordance with the present disclosure.

FIG. 4 depicts an example of a console 400. In this example, the console 400 includes a display 402 that provides feedback about the treadmill's energy efficiency based on the parameters of the user's workout. In this example, the display indicates that the parameters of the user's workout are such that the user no longer has to draw power from the residential power source.

Figure 5:
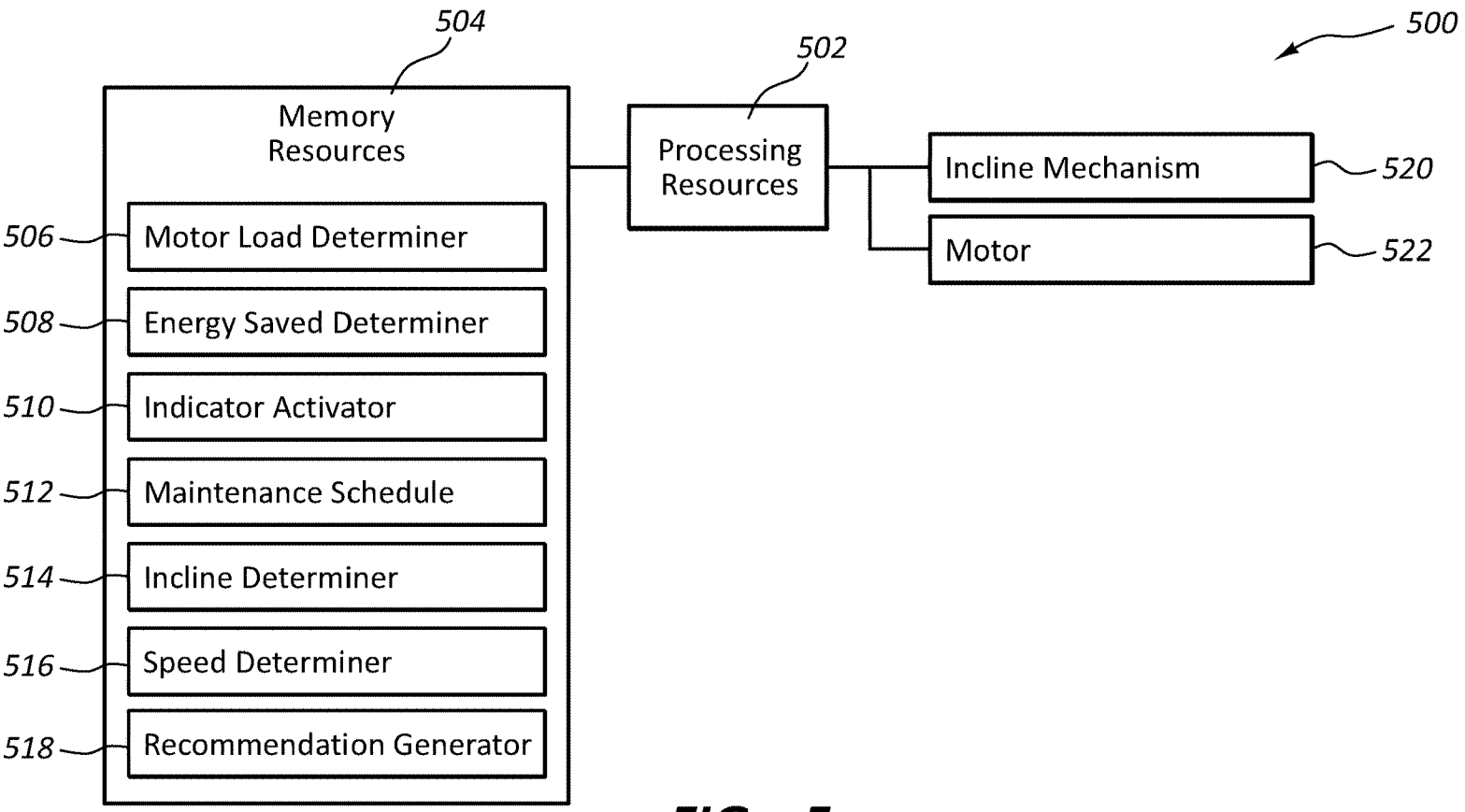
FIG. 5 illustrates a block diagram of an example of an energy efficiency indicator system in accordance with the present disclosure.

FIG. 5 depicts an example of an energy efficiency indicator system 500. In this example, the energy efficiency indicator system 500 includes processing resources 502 and memory resources 504. The memory resources 504 may cause the processing resources 502 to carry out functions programmed in the memory resources 504. In this example, the memory resources 504 include a motor load determiner 506, an energy saved determiner 508, an indicator activator 510, a maintenance schedule 512, an incline determiner 514, a speed determiner 516, and a recommendation generator 518.

The processing resources 502 may be in communication with I/O resources, which may include a receiver, a transmitter, a transceiver, another type of communication device, or combinations thereof. Further, the processing resources 502 may be in direct communication or in communication through the I/O resources with an incline mechanism 520, a motor 522, or combinations thereof.

Figure 6:
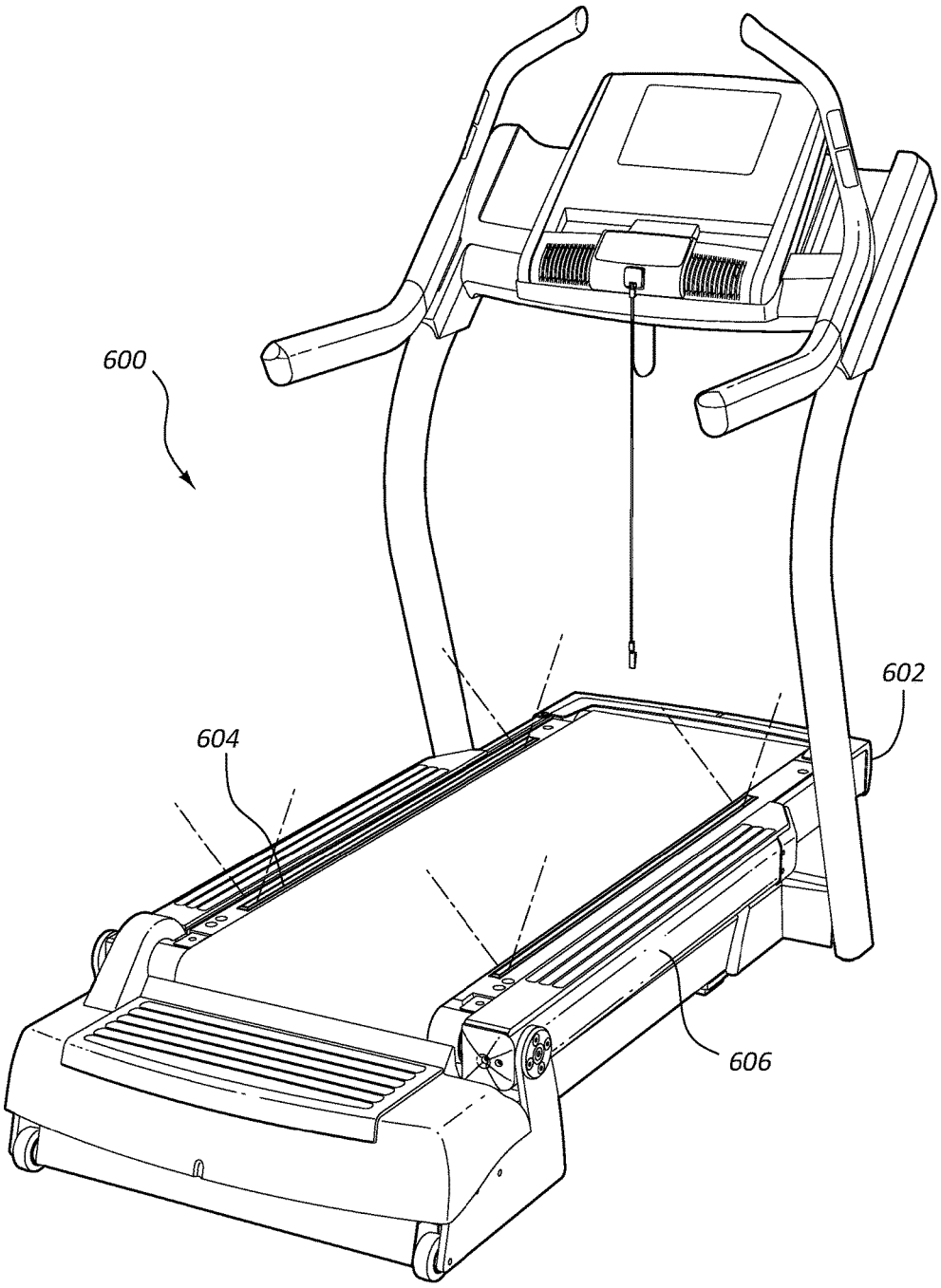
FIG. 6 illustrates a perspective view of an example of a treadmill in accordance with the present disclosure.

FIG. 6 depicts an example of the treadmill 600 with a deck 602. In this example, an energy efficiency indicator 604 is incorporated into the deck 602, and the energy efficiency indicator 604 is a light that is incorporated into a side rail 606 of the deck 602.

GENERAL DESCRIPTION

In general, the invention disclosed herein may provide users with a treadmill that can indicate to the user when the treadmill is being used efficiently. A motor is used to drive the treadmill's tread belt. The amount of energy used by the motor can be affected by different decisions that the user makes, such as the incline at which the user exercises, the speed at which the tread belt is moving, the amount of maintenance that the user puts into his or her treadmill, and so forth. An energy efficiency indicator can be used to communicate to the user when the treadmill's power load is operating at or above a predetermined energy efficiency threshold. In some cases, a determination of whether the treadmill is operating at or above the energy efficiency threshold is based on a measurement taken from the motor. In other examples, the determination of whether the treadmill is operating at or above the energy efficiency threshold is based on at least one factor that contributes to the amount of load on the motor. For example, the determination of whether the power load is at or above the energy efficiency threshold may be based on the incline of the deck, the speed that the tread belt is moving, a factor affected by performing maintenance, another factor, or combinations thereof.

Some commercially available treadmills generate electricity as the user causes the tread belt to move and the treadmill uses excess power to operate portions of the treadmill or another device. In contrast, the present invention is directed towards notifying the user when the user is operating the treadmill in a manner that lowers the load on the motor. Thus, in those examples where the treadmill is powered using the alternating current from the user's residence, the present invention encourages the user to use the treadmill to lower his or her residential power usage. Thus, the user is encouraged to use the treadmill in a manner that lowers his or her power bill and/or conserves energy and therefore the environment. Some of these commercially available treadmills that generate power may include indicators that indicate the amount of produced electricity that is re-inputted into the treadmill or when electricity is being re-inputted into the treadmill to operate the treadmill. These indicators are not indicating when the total amount of energy required to operate the treadmill is reduced, but rather indicate that the user is supplying electricity to contribute to powering the treadmill or powering another device. In these situations, the total amount of power that these commercially available treadmills need to operate may remain the same, the difference being that an additional power source (i.e. the self-generated power) is now being used to meet at least some of the power needs. While this may have an effect of lowering the amount of electricity being used from the residential power source, the overall power needs to operate the treadmill remains the same. In contrast, the energy efficiency indicators do not indicate an amount of energy that was re-inputted into the treadmill or used to power another device, but rather indicates when the overall power requirements to operate the treadmill is lowered to a power level classified as being energy efficient.

The treadmill may include an exercise deck. The exercise deck may include a platform that has a first pulley located in a front portion of the deck and a second pulley located in a rear portion of the deck. A tread belt may surround the first and second pulleys and provide a surface on which the user may exercise. At least one of the first pulley and the second pulley may be connected to a motor so that when the motor is active, the pulley rotates. As the pulley rotates, the tread belt moves as well. The user may exercise by walking, running, or cycling on the tread belt's moving surface. In other examples, the tread belt is moved with the user's own power.

The exercise deck may be capable of having its front portion raised and lowered as well as its rear portion raised and lowered to control the lengthwise slope of the running deck. With these elevation controls, the orientation of the running deck can be adjusted as desired by the user or as instructed by a programmed workout.

In some cases, the treadmill includes an upright structure and a console connected to the upright structure. The console may include a display, an input mechanism for controlling various features and/or operational controls of the treadmill, an energy efficiency indicator, a speaker, a fan, another component of the treadmill, or combinations thereof.

The console may locate the input mechanism within a convenient reach of the user to control the operating parameters of the exercise deck. For example, the control console may include controls to adjust the speed of the tread belt, adjust a volume of a speaker integrated into the treadmill, adjust an incline angle of the running deck, adjust a decline of the running deck, adjust a lateral tilt of the running deck, select an exercise setting, control a timer, change a view on a display of the control console, monitor the user's heart rate or other physiological parameters during the workout, perform other tasks, or combinations thereof. Buttons, levers, touch screens, voice commands, or other mechanisms may be incorporated into the console incorporated into the treadmill and can be used to control the capabilities mentioned above. Information relating to these functions may be presented to the user through the display. For example, a calorie count, a timer, a distance, a selected program, an incline angle, a decline angle, a lateral tilt angle, another type of information, or combinations thereof may be presented to the user through the display.

The deck may be attached to a base. In some cases, the base includes a frame that includes a first longitudinal frame member and a second longitudinal frame member that is aligned with the first longitudinal frame member. The first and second longitudinal frame members may be connected to each other through at least one cross member. In some cases, a forward cross member connects the first and second longitudinal frame members within a front portion of the frame. In some examples, a rearward cross member connects the first and second longitudinal frame members in a rear portion of the base. The deck may be pivotally attached a portion of the base. In some cases, a rearward end of the deck is pivotally attached to the base.

An incline mechanism may be used to raise and/or lower the front portion of the deck. In some embodiments, as the front portion of the deck is raised and lowered, the slope of the exercise deck changes as the rear portion of the deck remains pivotally connected to the base. Any appropriate type of incline mechanism may be used in accordance with the principles described in the present disclosure. The incline mechanism may include a retractable cylinder that has a first end connected to the deck and a second end attached to the base. The cylinder may extend to elevate the front portion of the deck or retract to lower the front portion of the deck. In some examples, multiple cylinders are used to raise and lower the front portion of the deck. These cylinders may operate simultaneously or sequentially to raise and/or lower the front portion of the deck. Further, at least one cylinder used to raise and lower the front portion of the deck may be a multi-stage cylinder or a single stage cylinder.

In another embodiment, portion of the incline mechanism is incorporated into the upright structure. In one of these types of examples, a track may be incorporated into at least one of the first post and the second post of the upright structure. The portion of the deck may be connected to posts and movable within the tracks of the posts. In one case, the track may be rack, and a pinion is attached to the deck. As the pinions rotate, the track moves in accordance with the direction that the pinion is rotating. In another example, the front portion of the track may be connected to posts through a cable that is spooled about a winch. As the winch unwinds, the incline mechanism lowers the front portion of the deck. Conversely, as the winch winds up the cable, the front portion of the track is lifted.

The motor may be located in any appropriate location on the treadmill. For example, the motor may be located proximate the first pulley or the second pulley. The motor may drive the rotation of at least one of the pulleys to cause the tread belt to move. In some cases, the motor is connected to the pulley through a transmission belt, a gear set, another transmission mechanism, or combinations thereof. The motor may be located in the base and connect to the rear pulley in those situations where the rear pulley shares a rotational axis with the pivot connection attaching the deck to the base. In other examples, the motor may be located in the deck with the pulley. One advantage to having the motor in the base is that the motor's weight can contribute to the weight of the base to stabilize the treadmill and the incline mechanism has less weight to support as it raises and lowers the front portion of the deck.

The energy efficiency indicator may be incorporated into the console, the deck, the base, other portion of the treadmill, or combinations thereof. For example, the energy efficiency indicator may be in communication with a sensor that determines the energy consumed by the motor. In some cases, the motor is powered from a residential power source. The alternative power from the residential power source may be converted into direct current. The direct current may be supplied to the motor to cause the motor to rotate. The sensor in communication with the energy efficiency indicator may measure the electrical power supplied to the motor. In other examples, the sensor may measure the voltage supplied to the motor, the amount of current supplied to the motor, the resistivity of the circuits supplying the power to the motor, the impedance of the circuits supplying power the motor, another electrical characteristic of the circuits supplying power to the motor, or combinations thereof.

The measurements from the sensor may be sent to a processor that determines the amount of energy being consumed by the motor. In some cases, when the sensors' measurements indicate that the power being consumed by the motor is greater than a predetermined amount that is classified as being less than energy efficient, the processor may cause that no signal is sent to the energy efficiency indicator. In some examples, the processor may cause a signal to be sent to the energy efficiency indicator that inhibits the energy efficiency indicator from operating. In yet another example, the processor may send a signal to the energy efficiency indicator that instructs the energy efficiency indicator to communicate that the motor is operating at an inefficient level.

In those examples that use a sensor, when the measurements from the sensor indicate that the motor is operating with an energy efficiency below a predetermined power threshold, the processor may send a signal to the energy efficiency indicator to instructor the energy efficiency indicator to communicate that the power load is running at an efficient level. In some cases, the processor may communicate to the energy efficiency indicator the motor's load so that the energy efficiency indicator can communicate to the user how efficient the motor is being operated.

In other examples, other factors are used to determine the power load. In one example, the power load is determined based on just the incline angle of the deck. When a user is standing on an inclined deck, gravity pulls on the user's weight which contributes to some of the energy needed to move the tread belt. As a result, the power load may be less when the deck is inclined. As such, the steeper the incline of the deck, the more that the user's weight may contribute to moving the tread belt. In these examples, a sensor may measure the deck's incline, and a processor may send a command to the energy efficiency indicator based on the measurements of the incline sensor. In other examples, the incline mechanism sends a signal to the energy efficiency indicator reporting its incline angle. In yet other examples, when a signal is sent to the incline mechanism to instruct the deck to be at an angle, a copy of the instructions is sent to the processor that determines whether to activate the energy efficiency indicator based on the angle to which the deck is instructed to move.

The speed that the tread belt moves affects the power load. In some examples, the speed at which the tread belt is moving is used to determine the power load. The energy efficiency indicator may be activated, at least in part, by the measured or instructed speed of the tread belt.

Further, the efficiency of the motor may also be based on the maintenance performed on the motor and other components of the treadmill. For example, regularly greasing the bearings that support the pulleys can reduce the amount of friction produced at the pulleys and therefore reduce the amount of power that needs to be supplied to the motor to move the tread belt. Likewise, cleaning underneath the tread belt may also reduce the friction that increase the load on the motor. Additionally, keeping up with a maintenance schedule that replaces worn parts, applies lubricant, tightens bolts, and other types of routine maintenance may also reduce the load on the motor. In some instances, the treadmill may record when maintenance is performed, and calculate the efficiency improvement that ought to occur based on the type of maintenance performed.

While the examples of above have referred to just some of the factors that affect the efficiency of the power load, other factors may be used to determine the power load. For example, the temperature of the ambient environment, the user's weight, the operation and power used to power a treadmill fan or other type of cooling system, and other factors may be used to determine the power load. In some examples, just a single factor is used to determine the power load. In other examples, at least two of the factors are used to determine the power load.

Any appropriate type of energy efficiency indicator may be used in accordance with the present disclosure. In one example, the energy efficiency indicator includes a light that illuminates when the power load is above an energy efficiency threshold. The light may be a green light. But, any appropriate light color may be used in accordance with the principles described herein. In some examples, the energy efficiency indicator may include a first light of a first color to indicate that that motor is operating at an efficient power level and a second light of a second color to indicate that the motor is operating at an inefficient power level. In some cases, a single light is used to indicate when the motor is operating at an efficient level and an ineffective level. In these circumstances, the covering over the light may change so that different color are presented to the user.

In another example, a display in the console communicates various types of information to the user about the motor's load. In one instance, the display communicates just whether the motor is operating at an efficient power level or an inefficient power level. In other examples, the display presents additional information about the power load. In one instance, the display may present the amount of power being used by the motor, how far away the current power load is from the predetermined energy efficiency threshold, the motor's power load history throughout the workout, the motor's power load history across multiple workouts, other types of information, or combinations thereof. In some cases, the display may present a graph of the motor's power load that identifies the current motor. In some cases, the display may present a graph that presents both the current power load and the predetermined energy efficiency threshold.

Further, the display may present to the user recommendations on how to improve the efficiency of the power load. In some examples, the recommendations may be depicted in just those circumstances where the power load is not being used efficiently. For example, when the deck is orientated at a substantially flat or negative angle, the display may present a recommendation to have the deck inclined to converse energy. Further, the display may present a recommendation to the user to slow down or speed up the tread belt's rate of travel to optimize the motor's load. In yet another example, the display may present a recommendation to the user to perform general or specific maintenance to improve the efficiency of the power load.

In other examples, the display may present one or more recommendations regardless of whether the power load is in an efficient range. In these types of examples, the display may present the recommendations continuously. In other examples, the recommendations may be presented at a periodic interval, or the presentation of the recommendations is trigger based. For example, the recommendation to improve the energy efficiency may occur when a workout is started, when a predetermined amount of time is reached after the workout has started, then the user instructs the incline mechanism to change the deck's angle, when the user instructs the treadmill to change the tread belt's speed, when a maintenance task is overdue, other triggers, or combinations thereof.

One event that may trigger the energy efficiency indicator system is activation of the incline mechanism. In some cases, the energy efficiency indicator may receive a command in response to the activation of the exercise deck incline mechanism. This command may include instructions to measure the power load. In response to measuring the load, the processor may receive a measurement that indicates whether the power load is above or below an energy efficiency threshold. If the measured load is less than the threshold, instructions may be sent to the energy efficiency indicator to communicate to the user that he or she is operating the treadmill in an energy efficient manner. If the measured power load is over the threshold, either no instructions are sent based on the measurement or a recommendation is instructed to be presented to the user to recommend changing an attribute of the workout to improve the energy efficiency of the motor.

In some embodiments, the predetermined energy efficiency threshold may change depending on the type of workout being performed by the user. For example, if the user is performing a walking workout, the predetermined energy efficiency threshold may be different that if the user is performing a running workout or a cycling workout.

In some cases, a sensor in communication with the motor or the circuits providing power to the motor may be in hard wired communication with a processor or with the energy efficiency indicator. Yet, in other examples, the sensor is in wireless communication with either the processor or the energy efficiency indicator.

In some examples, the treadmill includes multiple motors to operate the movement of the tread belt. In one of these examples, a single sensor may be used to measure at least one electrical characteristic of a portion of the circuitry providing power to both the motors. In another example, separate sensors are used to determine the individual loads on each of the motors. In some cases where an additional power source is used with the motor to power the movement of the tread belt, a separate sensor may be used to measure the output of the additional power source.

In some cases, the energy efficiency indicator is in communication with a mobile device or another type of remote device. In these cases, the efficiency at which the treadmill was operated may be stored by a third party, a fitness tracking program, by the manufacturer, a service provider, another type of party, or combinations thereof.

The energy efficiency indicator mechanism may include a combination of hardware and programmed instructions for executing the functions of the energy efficiency indicator mechanism. The energy efficiency indicator mechanism may include processing resources that are in communication with memory resources. Processing resources include at least one processor and other resources used to process the programmed instructions. As described herein, the memory resources may represent generally any memory capable of storing data such as programmed instructions or data structures used by the energy efficiency indicator mechanism.

The processing resources may include I/O resources that are capable of being in communication with a remote device that stores the user information, workout history, external resources, databases, or combinations thereof. The remote device may be a mobile device, a cloud based device, a computing device, another type of device, or combinations thereof. In some examples, the energy efficiency indicator mechanism communicates with the remote device through a mobile device which relays communications between the energy efficiency indicator mechanism and the remote device. In other examples, the mobile device has access to information about the user.

The remote device may execute a program that can provide useful information to the energy efficiency indicator mechanism. An example of a program that may be compatible with the principles described herein includes the iFit program which is available through www.ifit.com. An example of a program that may be compatible with the principles described in this disclosure is described in U.S. Pat. No. 7,980,996 issued to Paul Hickman. U.S. Pat. No. 7,980,996 is herein incorporated by reference for all that it discloses. In some examples, the user information accessible through the remote device includes the user's age, gender, body composition, height, weight, health conditions, other types of information, or combinations thereof.

The processing resources, memory resources, and remote devices may communicate over any appropriate network and/or protocol through the input/output resources. In some examples, the input/output resources includes a transmitter, a receiver, a transceiver, or another communication device for wired and/or wireless communications. For example, these devices may be capable of communicating using the ZigBee protocol, Z-Wave protocol, BlueTooth protocol, Wi-Fi protocol, Global System for Mobile Communications (GSM) standard, another standard, or combinations thereof. In other examples, the user can directly input some information into the pacing mechanism through a digital input/output mechanism, a mechanical input/output mechanism, another type of mechanism, or combinations thereof.

The memory resources may include a computer readable storage medium that contains computer readable program code to cause tasks to be executed by the processing resources. The computer readable storage medium may be a tangible and/or non-transitory storage medium. The computer readable storage medium may be any appropriate storage medium that is not a transmission storage medium. A non-exhaustive list of computer readable storage medium types includes non-volatile memory, volatile memory, random access memory, write only memory, flash memory, electrically erasable program read only memory, magnetic based memory, other types of memory, or combinations thereof.

The memory resources may include a motor load determiner that represents programmed instructions that, when executed, causes the processing resources to determine the load on the motor. In some examples, the motor load determiner makes a motor load determination based on input from a sensor that measures at least one electrical characteristic of the motor and/or a circuit that provides electrical power to the motor. In another example, the motor load determiner makes the motor load determination based on at least one factor that affects the power consumption of the motor.

The memory resources may include an energy saved determiner that represents programmed instructions that, when executed, causes the processing resources to determine an amount of energy saved by the user implementing at least one attribute of the workout that reduces a load on the motor. For example, a sensor may measure the amount of power consumed by a motor before an energy reducing attribute of the workout is implemented. After the energy reducing attribute is implemented, the sensor may take at least one other measurement. The energy saved determiner may calculate the power consumption difference by implementing the energy reducing attribute. The amount of saved energy may be used to determine the current amount of energy being consumed to move the tread belt.

The memory resources may include an indicator activator that represents programmed instructions that, when executed, causes the processing resources to activate the energy efficiency indicator in response to determining that the motor load's energy consumption is below an energy efficiency threshold. In other examples, the indicator activator may trigger the energy efficiency indicator to activate when the energy consumption of the motor is lower than a conventional energy efficiency level.

The memory resources may include a maintenance schedule that indicates when specific tasks are to be performed to help maintain the motor's efficiency. The maintenance schedule may cause the display to make recommendations to perform certain types of maintenance. Further, the processor may consult with the maintenance schedule to determine if certain maintenance tasks are scheduled. When maintenance is overdue, the processor may determine that the motor is using a higher load than if the maintenance had been performed on schedule.

The memory resources may include a speed determiner that represents programmed instructions that, when executed, causes the processing resources to determine the speed of the belt. The speed determiner may measure the speed of the belt with a sensor to determine the belt's speed.

The memory resources may include a recommendation generator that represents programmed instructions that, when executed, causes the processing resources to generate at least one recommendation for improving the energy efficiency of the motor. The recommendations may be generated in response to a low efficiency energy use. In other examples, the recommendation may be triggered for failure to keep up with the maintenance schedule. In yet other examples, the recommendations may be triggered when the treadmill is being used efficiency, but the energy efficiency can still be improved. The recommendation generator may be triggered in response to another type of event. In yet other examples, the recommendations may be presented continuously or periodically.

Further, the memory resources may be part of an installation package. In response to installing the installation package, the programmed instructions of the memory resources may be downloaded from the installation package's source, such as a portable medium, a server, a remote network location, another location, or combinations thereof. Portable memory media that are compatible with the principles described herein include DVDs, CDs, flash memory, portable disks, magnetic disks, optical disks, other forms of portable memory, or combinations thereof. In other examples, the program instructions are already installed. Here, the memory resources can include integrated memory such as a hard drive, a solid state hard drive, or the like.

In some examples, the processing resources and the memory resources are located within the treadmill, a mobile device, an external device, another type of device, or combinations thereof. The memory resources may be part of any of these device's main memory, caches, registers, non-volatile memory, or elsewhere in their memory hierarchy. Alternatively, the memory resources may be in communication with the processing resources over a network. Further, data structures, such as libraries or databases containing user and/or workout information, may be accessed from a remote location over a network connection while the programmed instructions are located locally.

What is claimed is:

1. An exercise device, comprising:
a frame;
an exercise deck, the exercise deck including:
a platform;
a first pulley connected to a front portion of the platform;
a second pulley connected to a rear portion of the platform; and
a tread belt surrounding the first pulley and the second pulley;
a motor in mechanical communication with at least one of the first pulley and the second pulley to drive the tread belt; and
an energy efficiency indicator that actives in response to determining that a power load needed to operate the exercise device is below a predetermined energy efficient threshold during a performance of an exercise.

2. The exercise device of claim 1, wherein the power load that activates the energy efficiency indicator has a characteristic of being achieved by moving the exercise deck into an inclined orientation.

3. The exercise device of claim 1, wherein the power load that activates the energy efficiency indicator has a characteristic of being achieved by driving the tread belt within an energy efficient speed.

4. The exercise device of claim 1, wherein the power load that activates the energy efficiency indicator has a characteristic of being achieved by performing maintenance on the exercise device.

5. The exercise device of claim 1, wherein the energy efficiency indicator includes a light that illuminates in response to measuring below the predetermined energy efficient threshold.

6. The exercise device of claim 5, wherein the energy efficiency indicator has a characteristic of displaying a green color in response to measuring below the predetermined energy efficient threshold.

7. The exercise device of claim 1, further including:
an upright structure; and
a console attached to the upright structure;
wherein the energy efficiency indicator is incorporated into the console.

8. The exercise device of claim 1, wherein the energy efficiency indicator is incorporated into the platform.

9. The exercise device of claim 1, wherein the energy efficiency indicator indicates an amount of energy saved.

10. The exercise device of claim 1, further including:
an exercise deck incline mechanism; and
the energy efficiency indicator is in communication with the exercise deck incline mechanism;
wherein the energy efficiency indicator receives a command in response to activation of the exercise deck incline mechanism.

11. The exercise device of claim 10, wherein the command includes instructions to measure the power load.

12. The exercise device of claim 1, further including:
a processor and memory;
the memory including programmed instructions that, when executed, cause the processor to:
send a recommendation to a user to lower an amount of energy used by the motor during the performance of the exercise.

13. The exercise device of claim 12, wherein the recommendation includes a message to incline the exercise deck.

14. An exercise device, comprising:
a frame;
an exercise deck, the exercise deck including:
a platform;
a first pulley connected to a front portion of the platform;
a second pulley connected to a rear portion of the platform;
a tread belt surrounding the first pulley and the second pulley;
a motor in mechanical communication with at least one of the first pulley and the second pulley to drive the tread belt;
an energy efficiency indicator that actives in response to determining that a power load needed to operate the exercise device is below a predetermined energy efficient threshold during a performance of an exercise;
the energy efficiency indicator includes a light that illuminates in response to measuring below the predetermined energy efficient threshold; and
the energy efficiency indicator has a characteristic of displaying a green color in response to measuring below the predetermined energy efficient threshold.

15. The exercise device of claim 14, further including:
an upright structure; and
a console attached to the upright structure;
wherein the energy efficiency indicator is incorporated into the console.

16. The exercise device of claim 14, wherein the energy efficiency indicator indicates an amount of energy saved.

17. The exercise device of claim 14, further including:
an exercise deck incline mechanism; and
the energy efficiency indicator is in communication with the exercise deck incline mechanism;
wherein the energy efficiency indicator receives a command to measure the power load in response to activation of the exercise deck incline mechanism.

18. The exercise device of claim 14, further including:
a processor and memory;
the memory including programmed instructions that, when executed, cause the processor to:
send a recommendation to a user to lower an amount of energy used by the motor during the performance of the exercise.

19. The exercise device of claim 18, wherein the recommendation includes a message to incline the exercise deck.

20. An exercise device, comprising:

a frame;

an exercise deck, the exercise deck including:

a platform;

a first pulley connected to a front portion of the platform;

a second pulley connected to a rear portion of the platform;

a tread belt surrounding the first pulley and the second pulley;

a motor in mechanical communication with at least one of the first pulley and the second pulley to drive the tread belt;

an upright structure; and a console attached to the upright structure;

an energy efficiency indicator incorporated into the console that actives in response to determining that a power load needed to operate the exercise device is below a predetermined energy efficient threshold during a performance of an exercise;

the energy efficiency indicator includes a light that illuminates in response to measuring below the predetermined energy efficient threshold; and the energy efficiency indicator has a characteristic of displaying a green color in response to measuring below the predetermined energy efficient threshold;

an exercise deck incline mechanism; and the energy efficiency indicator is in communication with the exercise deck incline mechanism;

wherein the energy efficiency indicator receives a command to measure the power load in response to activation of the exercise deck incline mechanism.

* * * * *